US006701713B2

(12) United States Patent
Mandai et al.

(10) Patent No.: US 6,701,713 B2
(45) Date of Patent: Mar. 9, 2004

(54) PILOT BURNER, PREMIXING COMBUSTOR, AND GAS TURBINE

(75) Inventors: Shigemi Mandai, Hyogo (JP); Masaaki Matsuura, Hyogo (JP); Keijirou Saitoh, Hyogo (JP); Katsunori Tanaka, Hyogo (JP); Wataru Akizuki, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/195,412

(22) Filed: Jul. 16, 2002

(65) Prior Publication Data

US 2003/0014976 A1 Jan. 23, 2003

(30) Foreign Application Priority Data

Jul. 17, 2001 (JP) ..... 2001-217233

(51) Int. Cl.[7] ..... F02C 7/26
(52) U.S. Cl. ..... 60/737; 60/748
(58) Field of Search ..... 60/737, 738, 740, 60/746, 747, 748

(56) References Cited

U.S. PATENT DOCUMENTS

| | | | | | |
|---|---|---|---|---|---|
| 5,394,688 | A | * | 3/1995 | Amos | 60/39.23 |
| 5,901,555 | A | * | 5/1999 | Mandai et al. | 60/747 |
| 2002/0011070 | A1 | * | 1/2002 | Mandai et al. | 60/725 |
| 2003/0110774 | A1 | * | 6/2003 | Saitoh | 60/737 |

FOREIGN PATENT DOCUMENTS

| | | |
|---|---|---|
| JP | 2001-254947 | 9/2001 |

* cited by examiner

*Primary Examiner*—Ehud Gartenberg
(74) *Attorney, Agent, or Firm*—Oblon, Spivak, McClelland, Maier & Neustadt, P.C.

(57) ABSTRACT

A pilot nozzle diffusion-injects a fuel. A pilot swirler swirls a pilot air around the pilot nozzle. An air guide is arranged between the outer surface of the pilot nozzle and the pilot swirler. The air guide extends from the pilot swirler to a tip of the pilot nozzle. The air guide has a tip that protrudes beyond the tip of the pilot nozzle and this the tip of the air guide is bent away from a center of the pilot nozzle.

11 Claims, 5 Drawing Sheets

PILOT BURNER, PREMIXING COMBUSTOR, AND GAS TURBINE

FIELD OF THE INVENTION

The present invention relates to a pilot burner, a premixing combustor, and a gas turbine that generate a stable flame.

BACKGROUND OF THE INVENTION

FIG. 8 depicts a pilot burner and a main burner of a premixing combustor in a conventional gas turbine. A pilot burner 70 consists of an outer cylinder 71, a pilot swirler 72, a pilot nozzle 73 and a pilot cone 74. Fuel is injected and diffused in the premixing combustor, as shown by black arrows 75, from the pilot nozzle 73. A plurality of premixing nozzles 76 those inject premixed gas are provided around the pilot nozzle 73. This fuel injected from the pilot nozzle 73 is burnt in the form of a flame and this flame helps combust the premixed gas injected from the premixing nozzles 76.

Pilot air is made to flow from left ("upstream") to right ("downstream") as shown by white arrows. The pilot swirler 72 functions to circulate the pilot air around the pilot nozzle 73 to improve the combustion efficiency. The pilot swirler 72 surrounds the pilot nozzle 73. However, the pilot swirler 72 is not directly attached to the pilot nozzle 73 but arranged towards the side of the outer cylinder 71.

The combustion of the premixed gas is conducted at a high temperature of about 1500 degree centigrade to suppress generation of toxic thermal NOx gas. However, the combustion of the fuel is conducted at relatively low temperature. As a result, thermal NOx is disadvantageously generated during the combustion of the fuel.

The amount of thermal Nox generated may be reduced by reducing the amount of the fuel. However, if the fuel reduced, the flame obtained by burning the fuel becomes unstable. In the worst case the flame may be extinguished because of the blow of the pilot air. Since this flame has a great influence on the combustion of the premixed gas, it is preferable that the flame is stable and does not extinguish.

SUMMARY OF THE INVENTION

It is an object of this invention to provide a stable flame.

According to a pilot burner of one aspect of the present invention, a pilot nozzle diffusion-injects a fuel, a pilot swirler swirls a pilot air around the pilot nozzle, an air guide is arranged between the outer surface of the pilot nozzle and the pilot swirler. The air guide extends from the pilot swirler to a tip of the pilot nozzle. The air guide has a tip that protrudes beyond the tip of the pilot nozzle and this the tip of the air guide is bent away from a center of the pilot nozzle.

According to a pilot burner of one aspect of the present invention, a pilot nozzle diffusion-injects a fuel, a pilot swirler swirls a pilot air around the pilot nozzle, an air guide is arranged between the outer surface of the pilot nozzle and the pilot swirler. The air guide extends from the pilot swirler to a tip of the pilot nozzle. The air guide has a tip that protrudes beyond the tip of the pilot nozzle and this the tip of the air guide is bent radially with respect to a center of the pilot nozzle.

The premixing combustor according another aspect of the present invention is provided with the pilot burner according to the present invention.

The gas turbine according still another aspect of the present invention is provided with the pilot burner according to the present invention.

Other objects and features of this invention will become apparent from the following description with reference to the accompanying drawings.

DETAILED DESCRIPTIONS

Embodiments of the present invention will be explained hereinafter in detail with reference to the accompanying drawings. It is noted that the present invention is not limited by this embodiment.

Figure 1:
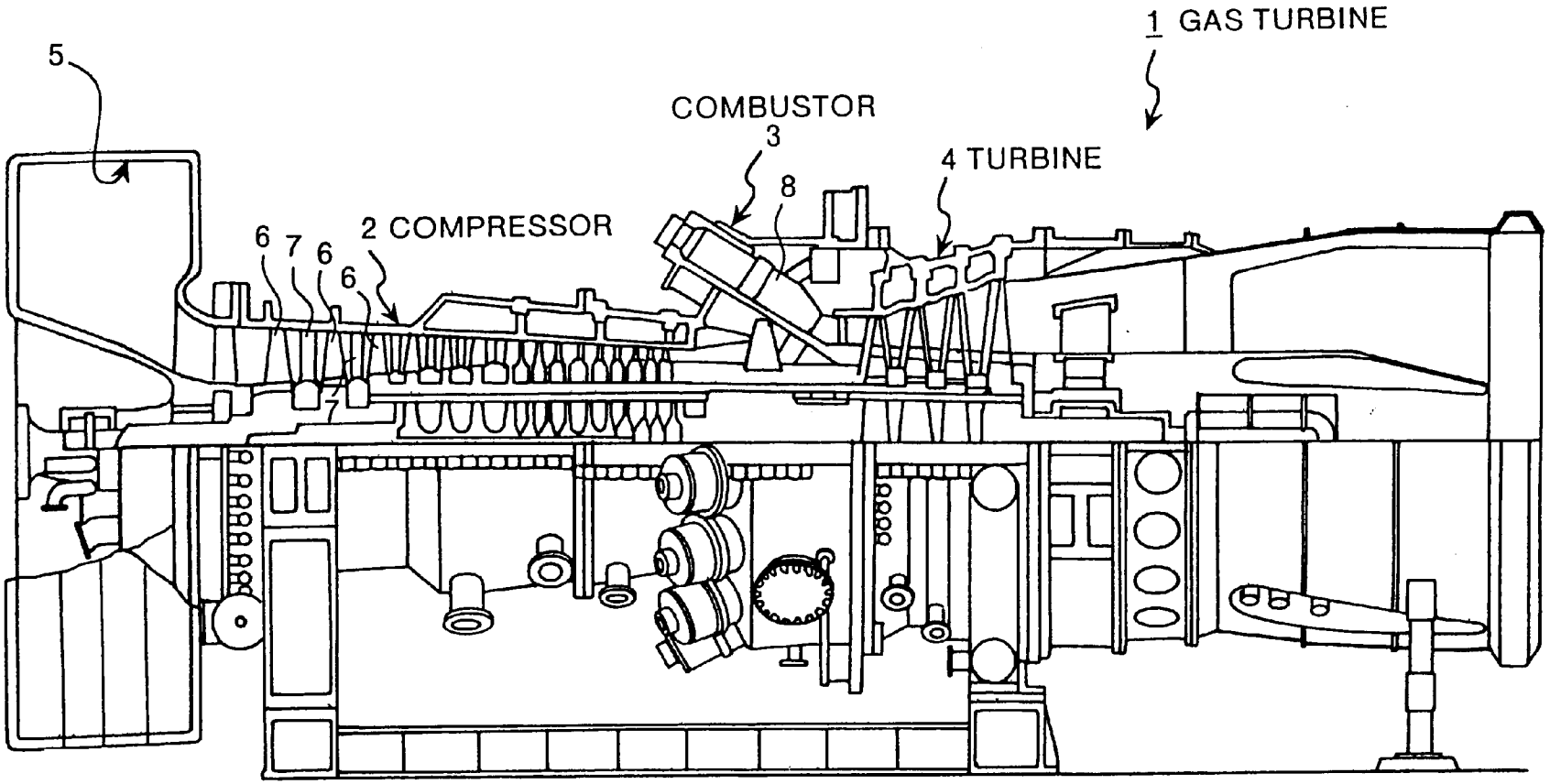
FIG. 1 is a cross-sectional view which shows an overall gas turbine according to this embodiment.

FIG. 1 depicts an overall view of the gas turbine 1 according to one embodiment of the present invention. The gas turbine 1 consists of a compressor 2, a combustor 3 and a turbine 4 among other structure. Air is introduced in the combustor 2 from an air inlet 5. The compressor 2 compresses the air with the help of a plurality of moving blades 6 and stationary blades 7. The compressed air is feed to the combustor 3. In the combustor 3, the compressed air is mixed with a fuel, the mixture of air and fuel is combust to obtain high pressure combustion gas. The combustion gas is made to pass through a tail pipe 8 and rotate the turbine. The turbine has a plurality of stages of rotors.

Figure 2:
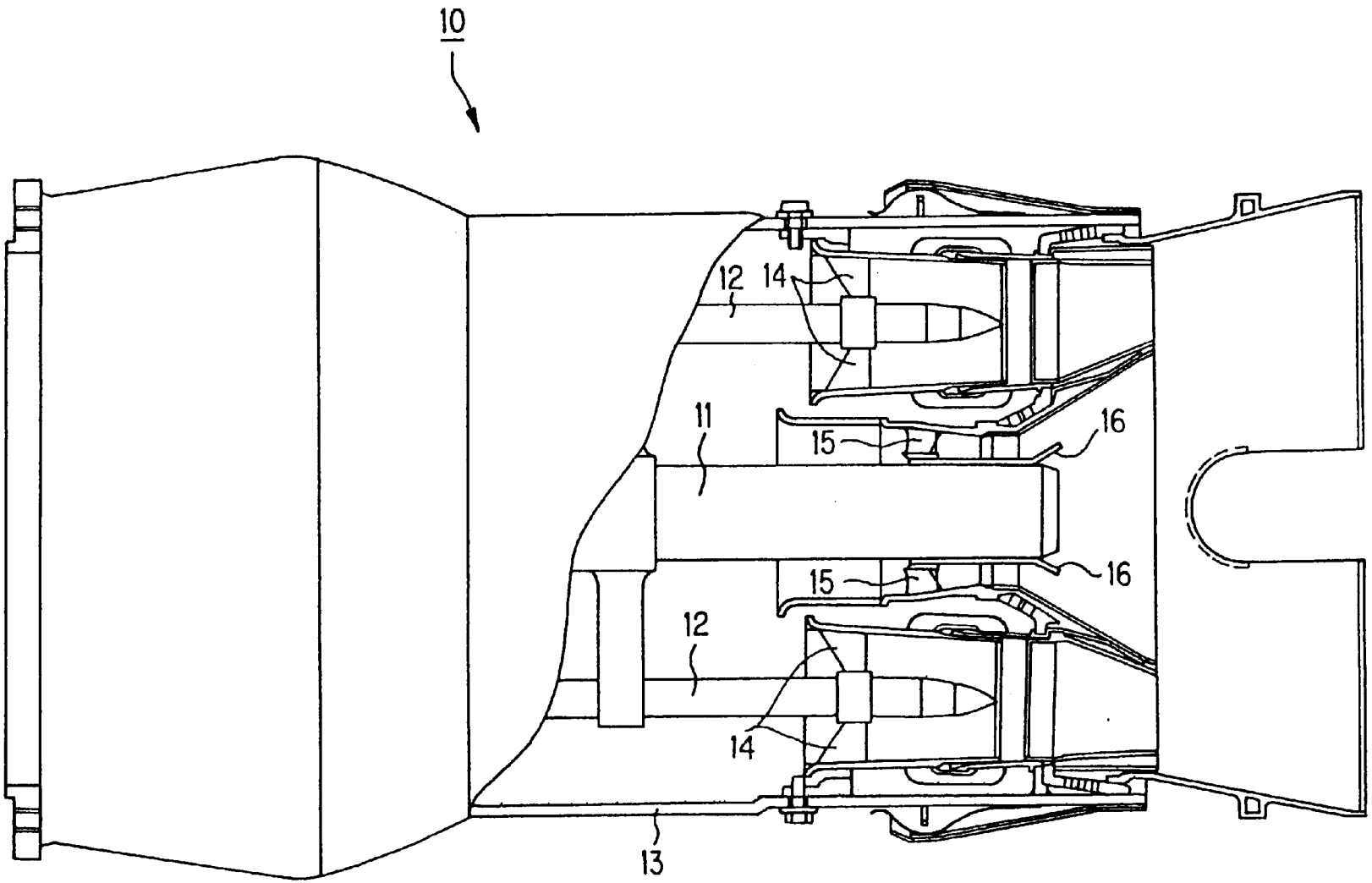
FIG. 2 is a partial cross-sectional view which shows a premixing combustor according to this embodiment.

FIG. 2 depicts a premixing combustor 10 according to one embodiment of the present invention. The premixing combustor 10 includes a pilot burner 11 and a plurality of premixing nozzles 12 arranged around the pilot burner 11. The pilot burner 11 and the premixing nozzles 12 enclosed by a cylindrical container 13. The premixing nozzles 12 are supported by a main swirler 14 and inject and mix a fuel to and with the compressed air which is turned into a revolving flow by the main swirler 14. The pilot burner 11 is supported by a pilot swirler 15 near its tip end and injects a pilot fuel diagonally forward from the tip end. As a result, a flame generated thereby becomes a starting flame which helps the premixing nozzles 12 combust the premixed gas.

The pilot swirler 15 is provided with an air induction plate 16 to be almost closely attached to the side surface of the pilot nozzle 11 toward the direction of the tip end of the pilot nozzle 11. In addition, the end of the air induction plate which is located on the tip end of the pilot nozzle 11 is provided to be bent radially relative to the axis of the pilot nozzle 11. This air induction plate 16 entangles the compressed air which is carried from the upstream and forms a vortex. As a result, the fuel which is injected from the pilot nozzle 11 and the air stay, making it possible to generate a stable starting flame.

Figure 3:
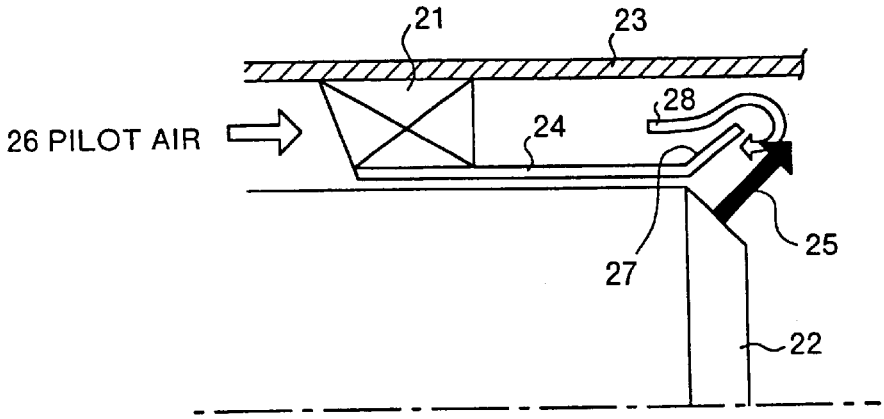
FIG. 3 is an enlarged outside view which shows a pilot burner according to this embodiment.

The bent shape of the end of the air induction plate 16, the shape of the air induction plate itself and a case in which the position of a fuel injection port is changed will be explained. FIG. 3 is an enlarged outside view which shows the pilot burner according to this embodiment. A pilot swirler 21 is provided on an outer cylinder 23 to surround a pilot nozzle 22. An air induction plate 24 is provided to be almost closely attached to the side surface of the pilot nozzle from the pilot swirler 21 toward the direction of the tip end of the pilot nozzle 22. The air induction plate 24 is almost closely attached to the side surface of the pilot nozzle 22 in view of processing error, assembly error, thermal expansion error. Ideally, this means that the air introduction plate 24 is closely attached to the side surface of the pilot nozzle 22.

An injection port (not shown) is provided on the tip end of the pilot nozzle 22 and a fuel is spread and injected from the injection port diagonally forward as indicated by an arrow 25. The pilot swirler 21 functions to revolve the pilot air which flows in a space which is formed between the outer cylinder 23 and the pilot nozzle 22 from the upstream and to enhance combustion efficiency. The end 27 of the air induction plate 24 is located on the tip end of the pilot nozzle 22 and bent radially outward relative to the axis of the pilot nozzle 22.

If the end 27 of the air induction plate 24 is bent radially outward, the pilot air 26 turns around at the bent portion as indicated by an arrow 28 and a vortex is generated. This vortex can suppress the fuel from being blown away and prevent the fuel from being diluted by the flow of the pilot air 26, so that flame stabilizing capability eventually enhances. If the flame stabilizing capability enhances, it is possible to operate the combustor with a reduced pilot fuel and to thereby contribute to the reduction of the thermal NOx which recently surfaces as an issue.

Figure 4:
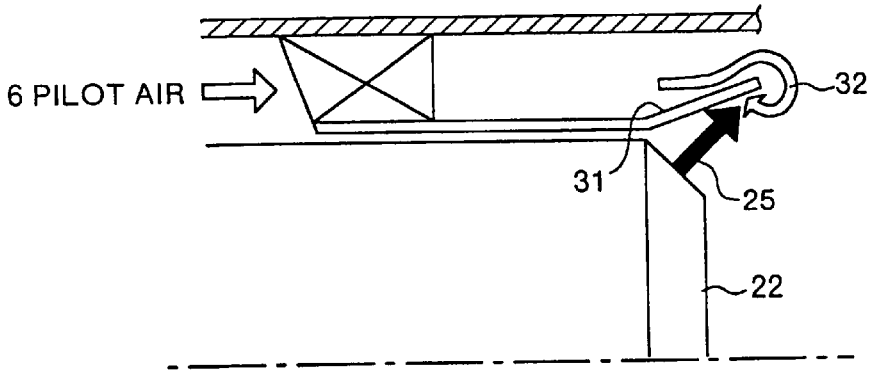
FIG. 4 is an enlarged outside view which shows a first modification of the pilot burner.

FIG. 4 depicts a first modification of the pilot burner according to this embodiment. In the first modification, an angle to which the end 31 of the air induction plate is bent is adjusted to spread and injected fuel diagonally forward from the pilot nozzle 22 as indicated by an arrow 25 directly collides against the end 31.

The pilot air 26 generates a vortex on the end 31 as indicated by an arrow 32 and the pilot air 26 is fully mixed with the fuel. Besides, at a collision point at which the fuel collides against the end 31, a fuel stagnation point appears. In this respect, similarly to the embodiment, it is possible to prevent the fuel from being diluted and to enhance flame stabilizing capability.

Figure 5:
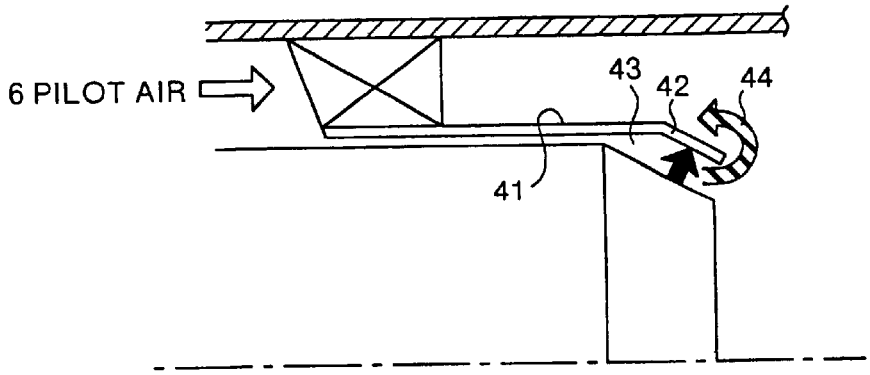
FIG. 5 is an enlarged outside view which shows a second modification of the pilot burner.

FIG. 5 depicts a second modification of the pilot burner according to this embodiment. In this second modification, the end 42 of an air induction plate 41 is bent radially inward relative to the axis. In this case, the air and the fuel are first fully mixed with each other in a clearance 43 which is formed between the end 42 of the air induction plate 41 and a fuel injection port (not shown). Thereafter, a vortex 44 which turns the mixture gas outward around the end 42 of the air induction plate 41 is generated. This can enhance the flame stabilizing capability of the pilot burner.

Figure 6:
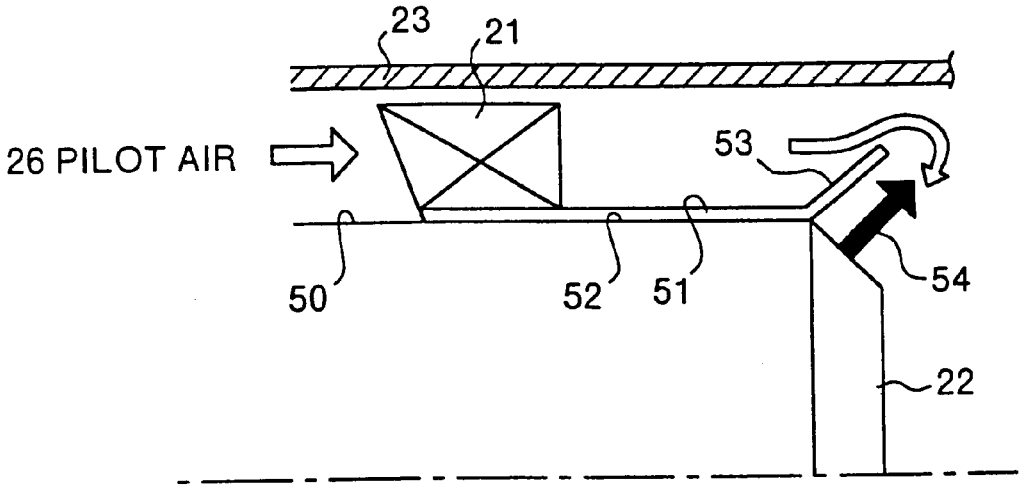
FIG. 6 is an enlarged outside view which shows a third modification of the pilot burner.

FIG. 6 depicts a third modification of the pilot burner according to this embodiment. This pilot burner is characterized in that the pilot swirler 21 which is conventionally provided on an outer cylinder 23 side is provided on the side surface 50 of the pilot nozzle 22. A plurality of pilot swirlers 21 are provided uniformly in the peripheral direction of the pilot nozzle 22.

Meanwhile, the air induction plate 51 is not always required to be connected to the pilot swirlers 21. Further, to secure a function of inducing the pilot air 26 toward the tip end of the pilot nozzle 22, it is necessary to provide the air induction plate 51 to be almost closely attached to the pilot nozzle side surface 52 with a certain point on the side surface 52 from the pilot swirlers 21 toward the direction of the tip end of the pilot nozzle 22 set as a starting point. The reason for almost closely attaching the air induction plate 51 to the pilot nozzle side surface 52 is the same as that explained in the embodiment.

In FIG. 6, the end 53 of the air induction plate 51 is bent radially outward relative to the axis of the pilot nozzle 22. The bent shape is not limited thereto but may be radially inward or a bent angle at which the fuel spread and injected collides against the end 53 as indicated by an arrow 54 may be selected. In any case, the flame stabilizing capability enhances by the mixture of the pilot air and the fuel in the vortex and the appearance of a stagnation point similarly to the embodiment and the first to second modifications.

Figure 7:
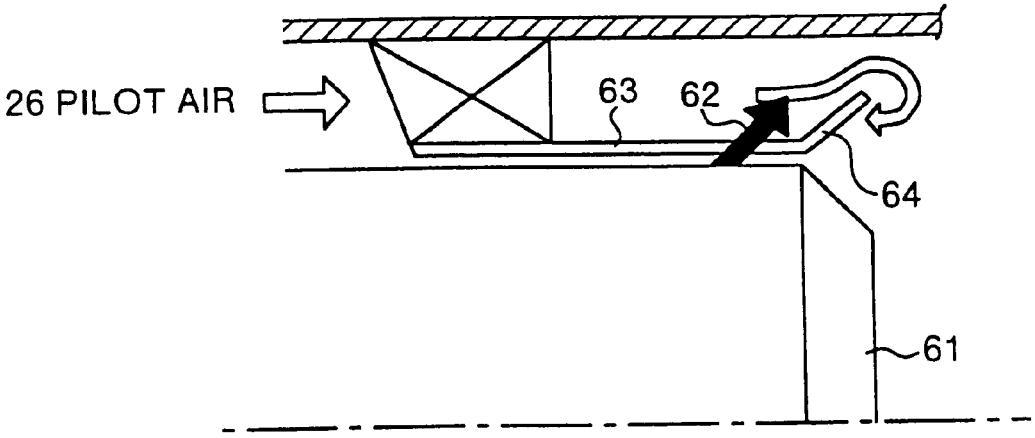
FIG. 7 is an enlarged outside view which shows a fourth modification of the pilot burner.
Figure 8:
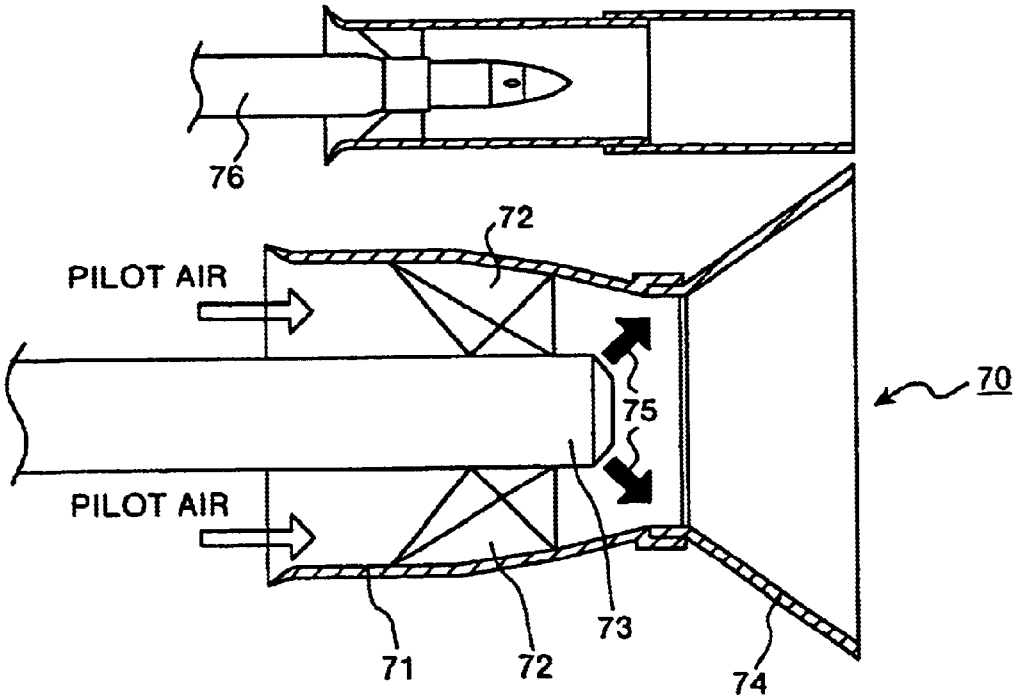
FIG.8 PRIOR ART
FIG. 8 is a schematic diagram which shows a pilot burner and the like of a conventional premixing combustor.

FIG. 7 depicts a fourth modification of the pilot burner according to this embodiment. This pilot burner is characterized by the injection position of a fuel spread and injected from the injection port of a pilot nozzle 61. That is, as indicated by an arrow 62, the fuel injection port is provided upward of the bend 64 of an air induction plate 63. A hole is provided in the air induction plate 63 to be matched to the injection port position. By doing so, the fuel is mixed with the air before the air is entangled in the bent portion 64.

As a result, the premixed gas of the air and the fuel is entangled in the bent portion 64 of the air induction plate 63, a vortex is generated and the fuel can be prevented from being diluted. Consequently, compared with a case in which only the air is entangled, the flame stabilizing capability enhances and it is possible to stably combust the gas with reduced fuel. A saving in fuel naturally contributes to the reduction of NOx. In FIG. 7, it is explained that the air induction plate is similar to that in FIG. 3. However, the air induction plate is not limited thereto but may be any one of the air induction plates shown in FIGS. 4 to 6.

As explained so far, according to the pilot burner of a premixing combustor of the present invention, the end of the air induction plate is bent radially. In the bent portion, therefore, a vortex of the pilot air and a fuel stagnation point is generated. These phenomena can advantageously prevent the combustion gas from being diluted and enhance the flame stabilizing capability of the pilot burner. In addition, since the flame stabilizing capability enhances, it is possible to operate the pilot burner with reduced fuel and to contribute to the thermal NOx reduction.

Moreover, the end of the air induction plate is bent radially outward. In the bent portion, therefore, a vortex of the pilot air and a fuel stagnation point is generated. These phenomena can advantageously prevent the combustion gas from being diluted and enhance the flame stabilizing capability of the pilot burner. In addition, since the flame stabilizing capability enhances, it is possible to operate the pilot burner with reduced fuel and to contribute to the thermal NOx reduction.

Furthermore, the end of the air induction plate is bent radially outward and the fuel collides against the end. In the bent portion, therefore, a vortex of the pilot air and a fuel stagnation point is generated. These phenomena can advantageously prevent the combustion gas from being diluted and enhance the flame stabilizing capability of the pilot burner. In addition, since the flame stabilizing capability enhances, it is possible to operate the pilot burner with reduced fuel and to contribute to the thermal NOx reduction.

Moreover, the end of the air induction plate is bent radially inward. In the bent portion, therefore, the fuel is well mixed with the pilot air and a vortex outward of the end is then generated. These phenomena can advantageously prevent the combustion gas from being diluted and enhance the flame stabilizing capability of the pilot burner. In addition, since the flame stabilizing capability enhances, it is possible to operate the pilot burner with reduced fuel and to contribute to the thermal NOx reduction.

Furthermore, the pilot swirlers and the air induction plate are provided on the side surface of the pilot nozzle and the end of the air induction plate is bent radially. In the bent portion, therefore, the fuel is well mixed with the pilot air and a vortex outward of the end is then generated. These phenomena can advantageously prevent the combustion gas from being diluted and enhance the flame stabilizing capability of the pilot burner. In addition, since the flame stabilizing capability enhances, it is possible to operate the pilot burner with reduced fuel and to contribute to the thermal NOx reduction.

Moreover, the injection port is provided upward of the bent portion of the end of the air induction plate and the fuel is injected diagonally forward from the hole provided in the side surface of the air induction plate. Therefore, while the air which flows from the upstream is premixed with the fuel, the premixed gas is entangled in the bent portion. If the air thus mixed with the fuel generates a vortex on the tip end of the pilot nozzle, the combustion gas is prevented from being diluted and the flame stabilizing capability of the pilot burner is enhanced. In addition, since the flame stabilizing capability enhances, it is possible to operate the pilot burner with reduced fuel and to contribute to the thermal NOx reduction.

The premixing combustor of the present invention utilizes the pilot burner of a premixing combustor according to present invention. Therefore, the air mixed with the fuel generates a vortex on the tip end of the pilot nozzle and the combustion gas can be thereby prevented from being diluted. As a result, the flame stabilizing capability of the pilot burner can be enhanced. In addition, since the flame stabilizing capability enhances, it is possible to operate the pilot burner with reduced fuel and to realize a premixing combustor which can reduce the thermal NOx.

The gas turbine of the present invention utilizes the premixing combustor according to present invention. It is, therefore, possible to enhance the flame stabilizing capability of the pilot burner and to provide a gas turbine which can reduce the thermal NOx by the reduction of the fuel.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A pilot burner of a premixing combustor comprising:

a pilot nozzle which diffusion-injects a fuel;

a pilot swirler arranged around the pilot nozzle and which swirls a pilot air around the pilot nozzle; and an air guide arranged between the outer surface of the pilot nozzle and the pilot swirler and extends from the pilot swirler to a tip of the pilot nozzle, the air guide guiding the pilot air and having a tip that protrudes beyond the tip of the pilot nozzle, wherein the tip of the air guide is bent radially with respect to a center of the pilot nozzle.

2. The pilot burner according to claim 1, wherein the tip of the air guide is bent away from the center of the pilot nozzle.

3. The pilot burner according to claim 1, wherein the fuel injected from the pilot nozzle collides against the tip of the air guide.

4. The pilot burner according to claim 1, wherein the tip of the air guide is bent towards the center of the pilot nozzle.

5. The pilot burner according to claim 1, wherein the injection port is provided upstream of a bent portion of the tip of the air guide, the fuel is injected diagonally forward from a hole provided in the side surface of the air guide.

6. A premixing combustor comprising:

a pilot burner including a pilot nozzle which diffusion-injects a fuel;

a pilot swirler arranged around the pilot nozzle and which swirls a pilot air around the pilot nozzle; and an air guide arranged between the outer surface of the pilot nozzle and the pilot swirler and extends from the pilot swirler to a tip of the pilot nozzle, the air guide guiding the pilot air and having a tip that protrudes beyond the tip of the pilot nozzle, wherein the tip of the air guide is bent radially with respect to a center of the pilot nozzle;

a plurality of premixing nozzles, which inject fuel, arranged around the pilot burner; and a cylindrical container that houses the pilot burner and the premixing nozzles.

7. A gas turbine comprising:

a compressor which compresses air;

a premixing combustor which mixes fuel and the compressed air burns the mixture to obtain combustion gas, the premixing combustor including a pilot burner including a pilot nozzle which diffusion-injects the fuel;

a pilot swirler arranged around the pilot nozzle and which swirls a pilot air around the pilot nozzle; and an air guide arranged between the outer surface of the pilot nozzle and the pilot swirler and extends from the pilot swirler to a tip of the pilot nozzle, the air guide guiding the pilot air and having a tip that protrudes beyond the tip of the pilot nozzle, wherein the tip of the air guide is bent radially with respect to a center of the pilot nozzle;

a plurality of premixing nozzles, which inject fuel, arranged around the pilot burner; and a cylindrical container that houses the pilot burner and the premixing nozzles; and a turbine which converts the combustion gas generated from the premixing combustor of the gas turbine into a rotating power.

8. A pilot burner of a premixing combustor wherein a plurality of pilot swirlers are provided uniformly in a peripheral direction on a side surface of a pilot nozzle which has an injection port injecting a fuel diagonally forward; an air guide is provided to be almost closely attached to the side surface from the pilot swirlers toward a tip end of the pilot nozzle; and a tip of the air guide which is located on the tip end of the pilot nozzle is bent radially relative to an axis of the pilot nozzle.

9. The pilot burner according to claim 8, wherein the injection port is provided upstream of a bent portion of the tip of the air guide, the fuel is injected diagonally forward from a hole provided in the side surface of the air guide.

10. A premixing combustor comprising:

a pilot burner wherein a plurality of pilot swirlers are provided uniformly in a peripheral direction on a side surface of a pilot nozzle which has an injection port injecting a fuel diagonally forward; an air guide is provided to be almost closely attached to the side surface from the pilot swirlers toward a tip end of the pilot nozzle; and a tip of the air guide which is located on the tip end of the pilot nozzle is bent radially relative to an axis of the pilot nozzle;

a plurality of premixing nozzles, which inject fuel, arranged around the pilot burner; and a cylindrical container that houses the pilot burner and the premixing nozzles.

11. A gas turbine comprising:

a compressor which compresses air;

a premixing combustor which mixes fuel and the compressed air burns the mixture to obtain combustion gas, the premixing combustor including a pilot burner wherein a plurality of pilot swirlers are provided uniformly in a peripheral direction on a side surface of a pilot nozzle which has an injection port injecting a fuel diagonally forward; an air guide is provided to be almost closely attached to the side surface from the pilot swirlers toward a tip end of the pilot nozzle; and a tip of the air guide which is located on the tip end of the pilot nozzle is bent radially relative to an axis of the pilot nozzle;

a plurality of premixing nozzles, which inject fuel, arranged around the pilot burner; and a cylindrical container that houses the pilot burner and the premixing nozzles; and a turbine which converts the combustion gas generated from the premixing combustor of the gas turbine into a rotating power.

* * * * *